US009226572B2

(12) United States Patent
Lai et al.

(10) Patent No.: US 9,226,572 B2
(45) Date of Patent: Jan. 5, 2016

(54) FOLDING TABLE

(71) Applicants: Jennifer Ying Lai, Rancho Cucamonga, CA (US); Jiaxun Cao, Rancho Cucamonga, CA (US)

(72) Inventors: Jennifer Ying Lai, Rancho Cucamonga, CA (US); Jiaxun Cao, Rancho Cucamonga, CA (US)

( * ) Notice: Subject to any disclaimer, the term of this patent is extended or adjusted under 35 U.S.C. 154(b) by 0 days.

(21) Appl. No.: 14/598,824

(22) Filed: Jan. 16, 2015

(65) Prior Publication Data

US 2015/0257526 A1 Sep. 17, 2015

Related U.S. Application Data

(60) Provisional application No. 61/979,202, filed on Apr. 14, 2014, provisional application No. 61/951,206, filed on Mar. 11, 2014.

(51) Int. Cl.

| | |
|---|---|
| ***A47B 3/00*** | (2006.01) |
| ***A47B 3/091*** | (2006.01) |
| ***A47B 3/02*** | (2006.01) |
| ***A47B 3/08*** | (2006.01) |
| ***B25H 1/04*** | (2006.01) |
| ***D06F 81/02*** | (2006.01) |

(52) U.S. Cl.

CPC ..... *A47B 3/0912* (2013.01); *A47B 3/02* (2013.01); *A47B 3/08* (2013.01); *A47B 3/0818* (2013.01); *B25H 1/04* (2013.01); *D06F 81/02* (2013.01); *A47B 2003/025* (2013.01); *A47B 2200/0037* (2013.01)

(58) Field of Classification Search

CPC ..... A47B 3/00; A47B 3/091; A47B 3/0912; A47B 3/0913; A47B 3/0915; A47B 3/0916

USPC ..... 108/115, 128; 248/188.6, 188, 188.1

See application file for complete search history.

(56) References Cited

U.S. PATENT DOCUMENTS

| | | | | | |
|---|---|---|---|---|---|
| 2,644,590 | A * | 7/1953 | Baxter | A47D 5/006 | 108/115 |
| 3,322,077 | A * | 5/1967 | Kovacik | A47B 3/00 | 108/115 |
| 3,722,702 | A * | 3/1973 | Marker, Jr. | A47F 5/13 | 108/115 |
| 5,622,119 | A * | 4/1997 | Hsieh | A47B 3/00 | 108/115 |
| 5,775,655 | A * | 7/1998 | Schmeets | A47B 5/00 | 108/115 |
| 5,927,214 | A * | 7/1999 | Schwartz | A47B 3/0815 | 108/115 |
| 6,786,162 | B1 * | 9/2004 | Volkmer | A47B 5/06 | 108/115 |
| 8,539,889 | B1 * | 9/2013 | Khalaf Allah | A47B 85/06 | 108/115 |
| 2005/0274300 | A1 * | 12/2005 | Chen | A47B 3/002 | 108/115 |
| 2006/0090675 | A1 * | 5/2006 | Mangano | A47B 3/002 | 108/115 |
| 2008/0017083 | A1 * | 1/2008 | VanNimwegen | A47B 3/08 | 108/121 |

* cited by examiner

*Primary Examiner* — Jose V Chen
(74) *Attorney, Agent, or Firm* — Clement Cheng

(57) ABSTRACT

A folding table has a plank, a substantially vertical support member, and a first leg having a first leg first section and a first leg second section. The first leg first section slides relative to the first leg second section when the table is folded between a deployed position and a stowed position. The first leg has an adjustable length. The first leg has a first leg upper joint allowing the first leg to fold between a first leg deployed position and a vertical stowed position. A second leg has a second leg first section and a second leg second section. The second leg first section is jointed to the second leg second section. The second leg has a second leg upper joint connected to the plank or the plank frame.

14 Claims, 9 Drawing Sheets

FOLDING TABLE

The present invention claims priority from U.S. provisional application 61/979,202 filed Apr. 14, 2014 entitled Folding Table and from U.S. provisional application 61/951,206 filed Mar. 11, 2014 entitled Folding Table, by same inventors Jennifer Ying Lai and Jiaxun Cao, the disclosures of which are incorporated herein by reference.

FIELD OF THE INVENTION

The present invention is in the field of folding tables

DISCUSSION OF RELATED ART

A variety of folding tables had been made in the prior art. Folding tables have generally had a pair of foldable legs. Unfortunately, many times, the folding legs require a substantial amount of strength to fold and unfold. Sometimes, more than one person is needed for folding the table.

SUMMARY OF THE INVENTION

A folding table has a plank and a substantially vertical support member. The plank or plank frame is directly or indirectly rotationally connected to the substantially vertical support member. The plank rotates between a substantially horizontal plank deployed position and a substantially vertical plank stowed position. The first leg has a first leg upper joint allowing the first leg to fold between a first leg deployed position and a first leg stowed position, where the first leg is substantially vertical. The first leg further includes a first leg sliding joint that telescopically retracts an upper portion of the first leg when the first leg is folding on the first leg upper joint between the first leg deployed position and the first leg stowed position.

A second leg has a second leg first section and a second leg second section. The second leg first section is jointed to the second leg second section. The second leg first section is a second leg upper section, and the second leg second section is a second leg lower section. The second leg upper section is biased into a straight collinear position relative to the second leg lower section when the second leg is in a second leg deployed position. The second leg upper section rotates relative to the second leg lower section when the second leg moves to a second leg stowed position. The second leg upper joint supports the plank. The substantially horizontal plank deployed position mechanically coincides with the second leg stowed position and the first leg stowed position. The substantially vertical plank stowed position mechanically coincides with the first leg deployed position and the second leg deployed position as being substantially vertically aligned in a folded configuration.

A folding table has a plank, a substantially vertical support member, and optionally a first leg having a first leg first section and a first leg second section. The preferred configuration of the first leg is not sectioned. Optionally, the first leg first section slides relative to the first leg second section when the table is folded between a deployed position and a stowed position. Optionally, the first leg has an adjustable length. Optionally, the first leg has a first leg upper joint allowing the first leg to fold between a first leg deployed position and a vertical stowed position. A second leg has a second leg first section and a second leg second section. The second leg first section is jointed to the second leg second section. The second leg has a second leg upper joint connected to the plank or the plank frame. The second leg first section and the second leg second section nest or do not nest with each other in the second leg stowed position.

The folding table optionally includes a third leg pivotally connected to the substantially vertical support member at a third leg swivel joint. A lower platform can be supported by the first leg. A lower platform support can support the lower platform. The lower platform support can be pivotally connected to the first leg. The lower platform support is pivotally connected to the lower platform. The plank may further include a plank frame. The plank frame can support the plank. The lower platform support is preferably connected pivotally to the vertical support member.

The first leg is optionally but not preferably formed as a first leg upper section hinged to the first leg lower section at a first leg upper section lower joint. Optionally, the first leg upper section has a first leg upper section lower member and a first leg upper section upper member hinged at a first leg upper section upper joint. The first leg upper section lower joint further includes a joint extension and a joint extension swivel connecting to the first leg upper section lower member. Also, the first leg is pivotally connected to the second leg. Again, the first leg is preferably not made in sections that fold relative to each other.

In a third embodiment, optionally a third leg pivotally is connected to the substantially vertical support member at a third leg swivel joint. The third leg is connected to the substantially vertical support member at a third leg swivel joint, and the third leg is swivel connected to the first leg at a first leg lower joint. The first leg is connected to the second leg upper section at an intermediate first leg upper joint. The second leg lower section has a locking member fitted to allow a sliding motion within a locking member slot formed on the second leg lower section. The locking member is biased by a locking member spring. The locking member engages a second leg locking notch formed on the second leg upper section lower end.

In a fourth embodiment, optionally a second plank is mounted to the substantially vertical support member at a second plank main swivel. The second plank is supported by a second plank support. The second plank is swivel connected to the second plank support at a second plank outside swivel. The second plank side rails each may have a second plank side rail slot. The second plank side rail slot receives a second plank rail support, and the second plank rail support is pivotally attached to the second plank side rails at a second plank outside swivel. The second plank rail support is also pivotally attached to the second plank rail support swivel and either the first leg middle joint or the second leg lower section.

Figure 1:
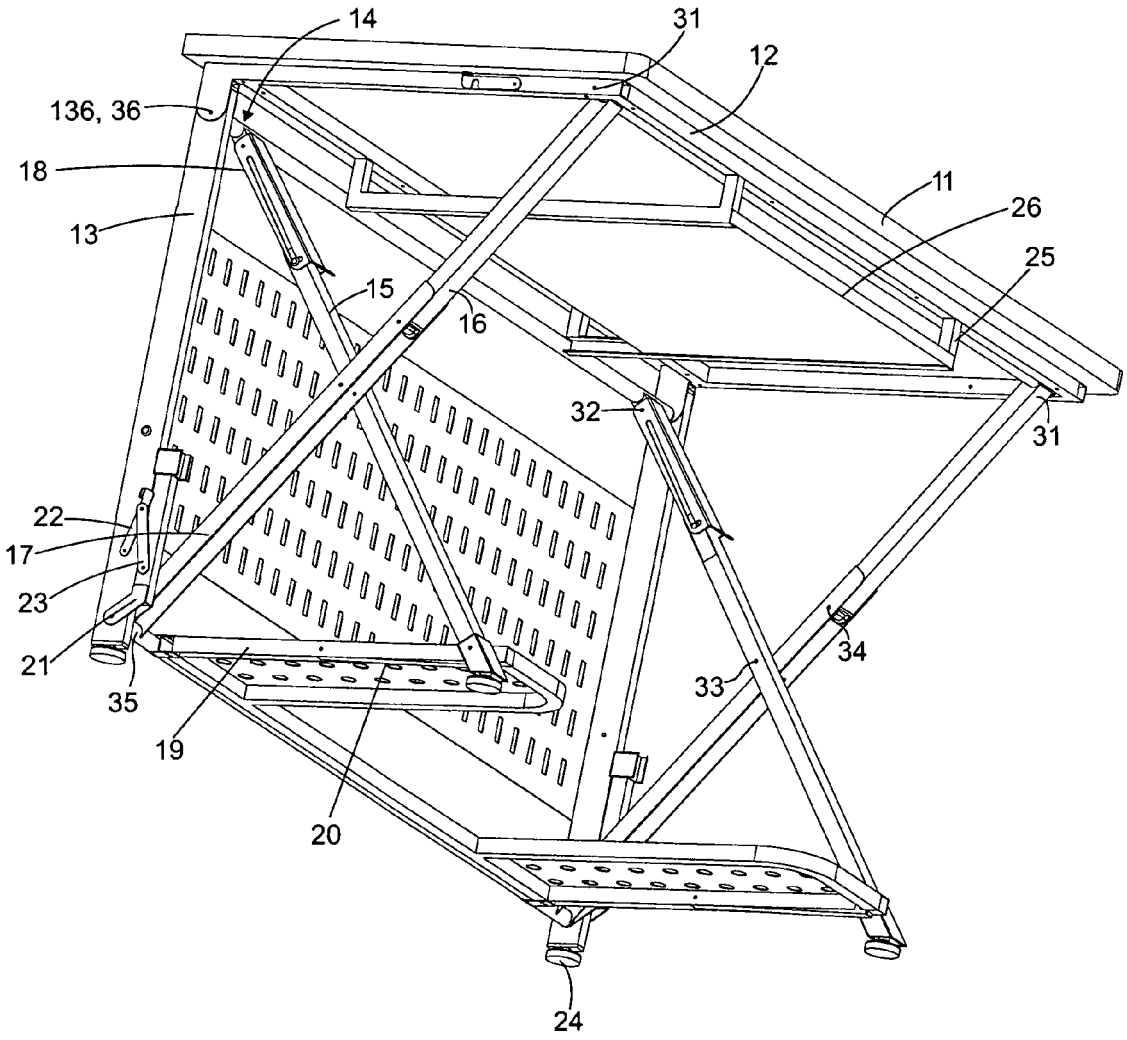
FIG. 1 is a perspective view of the present invention in open position.
Figure 2:
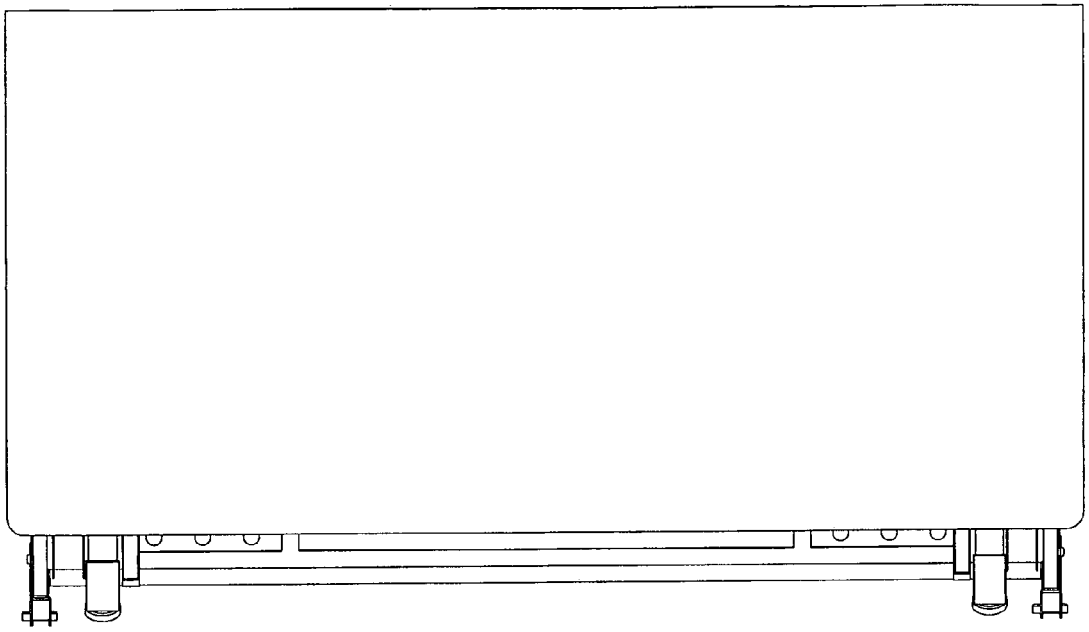
FIG. 2 is a front view of the present invention in closed position.
Figure 3:
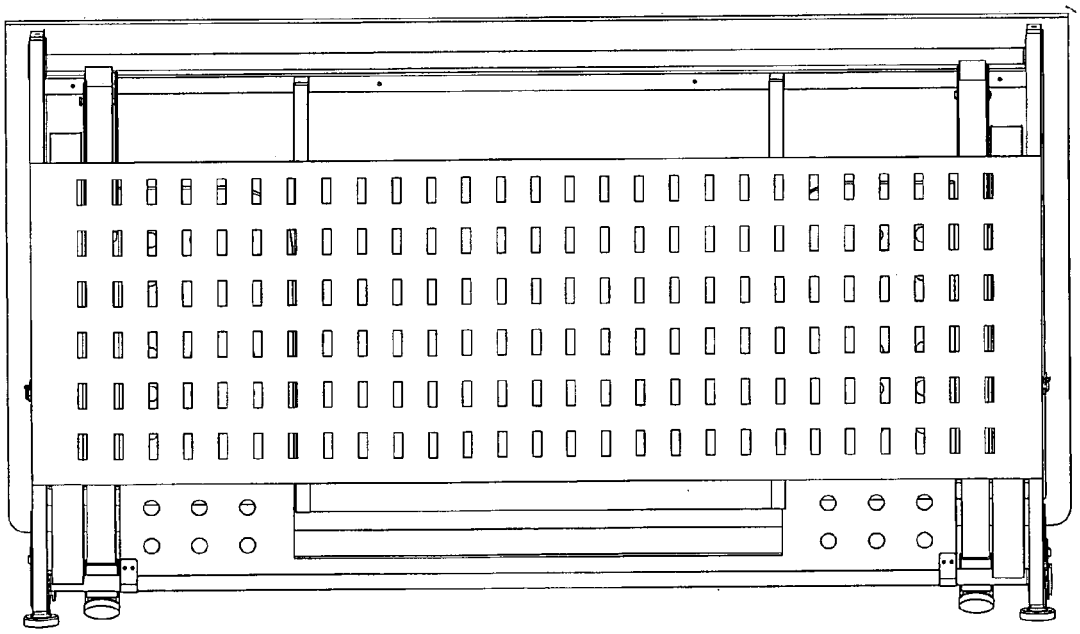
FIG. 3 is a rear view of the present invention in closed position.
Figure 4:
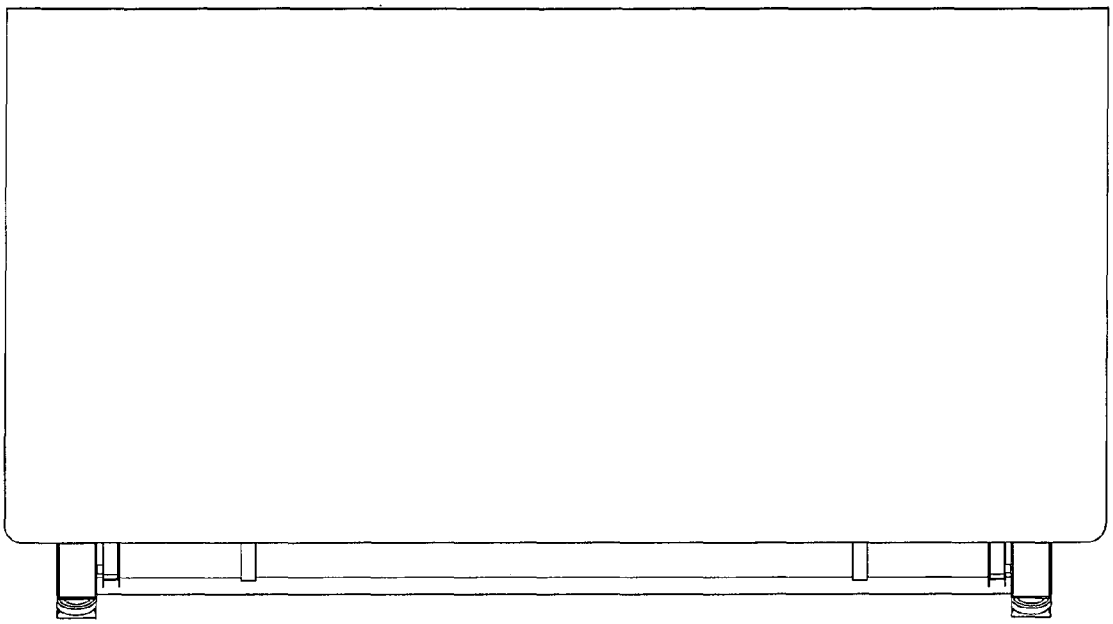
FIG. 4 is a top view of the present invention in open position.
Figure 5:
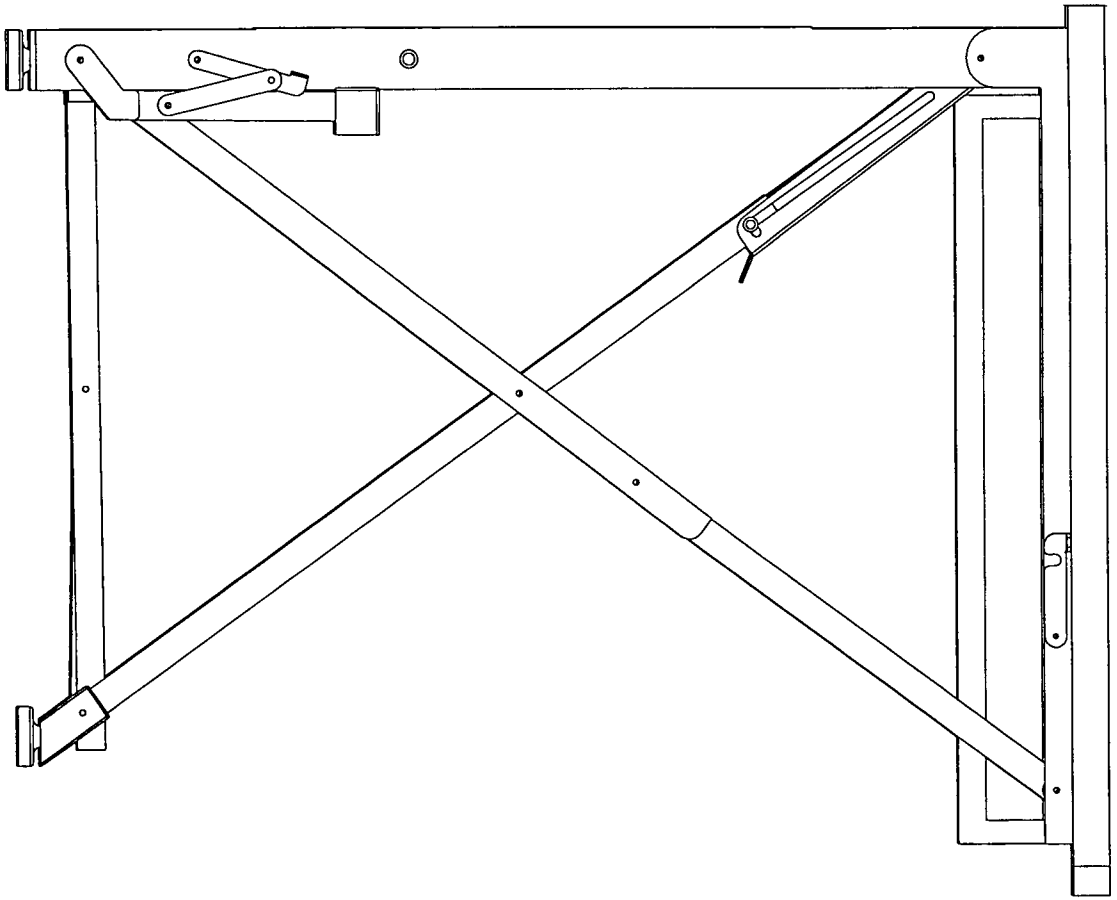
FIG. 5 is a side view of the present invention in open position.
Figure 6:
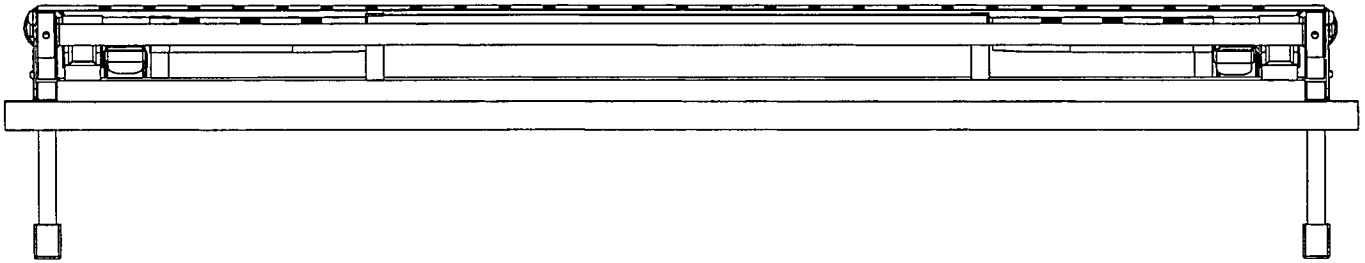
FIG. 6 is a top view of the present invention in closed position.
Figure 7:
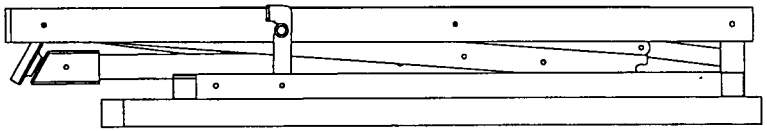
FIG. 7 is a side view of the present invention in closed position.
Figure 8:
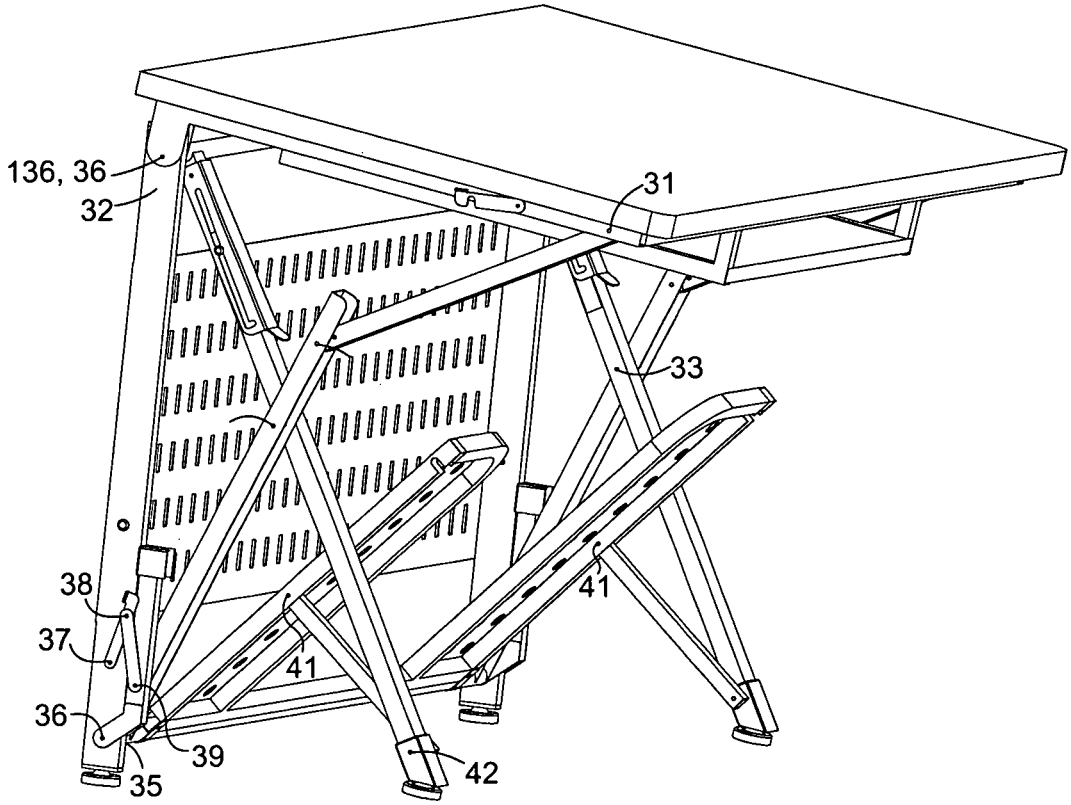
FIG. 8 is a partially open view showing folding of the table.
Figure 9:
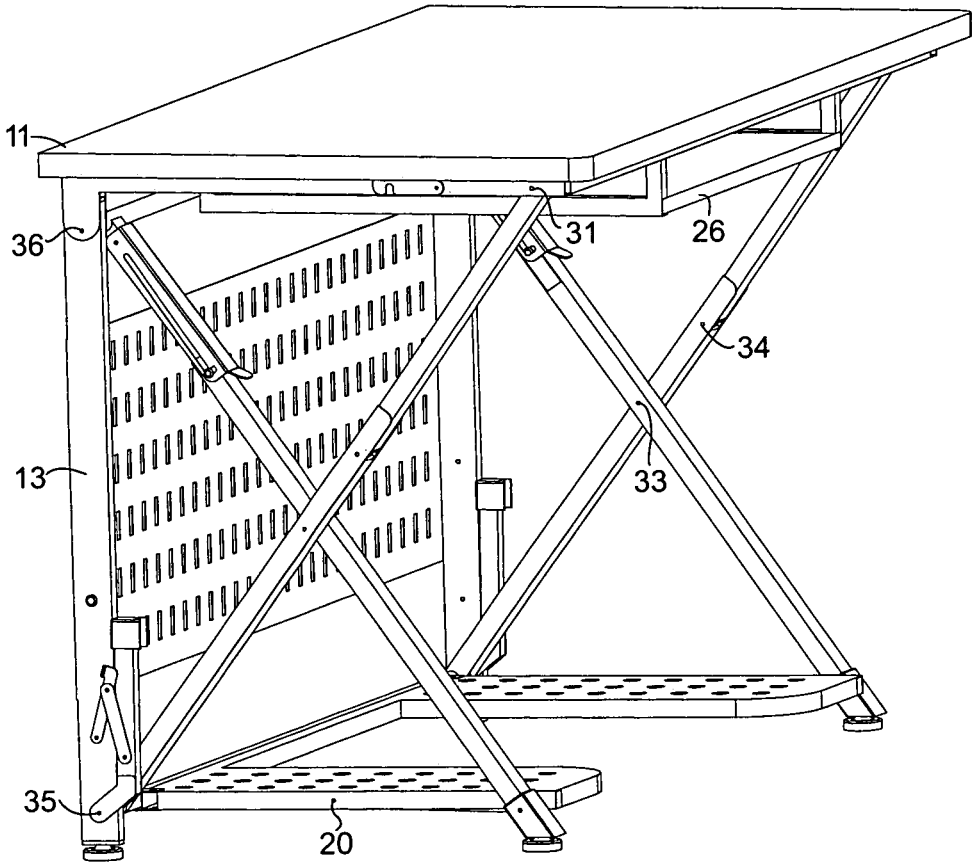
FIG. 9 is a perspective view of the present invention in open position showing an alternate position of the substantially vertical support member.

The following call out list of elements can be a useful guide in referencing the element numbers of the drawings.

11 Plank
12 Plank Frame
13 Substantially Vertical Support Member
14 First Leg Upper Joint
15 First Leg
16 Second Leg Upper Section
17 Second Leg Lower Section
18 First Leg Sliding Joint
19 Lower Platform
20 Lower Platform Support
21 Third Leg
22 Third Leg First Joint Member
23 Third Leg Second Joint Member
24 Bottom Foot
25 Drawer Support
26 Drawer
31 Second Leg Upper Joint
32 First Leg Upper Joint
33 First Leg Middle Joint
34 Second Leg Breaking Joint
35 Second Leg Lower Joint
36 Substantially Vertical Support Member Swivel Joint
136 Plank Swivel Joint
37 Third Leg First Joint Member Joint
38 Third Leg Middle Joint Member Joint
39 Third Leg Second Joint Member Joint
41 Lower Platform Support Inside Joint
42 Lower Platform Support Outside Joint

DETAILED DISCUSSION OF THE PREFERRED EMBODIMENT

The table frame generally has a plank 11 supported by a plank frame 12. The plank can be made of metal, fiberboard, or plastic or the like. When the plank is made of plastic or fiberboard, a metal frame can reinforce the surfaces, edges or periphery of the plank. Although the plank is preferably substantially rigid, the plank can be made as a flexible member. The plank can be made as a reflective, transparent or opaque member. The plank can be made as a square, rectangle or curved shape such as an ironing board, or a coffee table. The best mode of the plank is as a desk such as a student desk. The plank is directly or indirectly rotationally connected to the substantially vertical support member and can be connected via or to the first leg section. The first leg upper portion may have a first leg sliding joint that telescopically, glidingly or translationally moves relative to the first leg lower portion.

The plank folds from a 0° to a 90° angle relative to a substantially vertical support member 13 at the plank swivel joint 136, which can be with the substantially vertical support member swivel joint 36 or separate therefrom. The plank can be directly or indirectly hinged to the substantially vertical support member. A user can grasp the plank such as by an edge of the plank. The plank may have a handle for grasping. The handle can be a hardware handle, or an opening in the plank to allow the user to grip the edge of the plank. The user can be assisted by one or more shock or spring mechanisms. The plank folds downward into a stowed position from a deployed position.

Besides the substantially vertical support member 13, there is also a first pair of legs 15 and second pair of legs and a third supplemental leg pair. The first leg 15 is connected to a first leg upper joint 14 which can be rigid or pivotal with a horizontal crossbar. The first leg upper joint 14 is preferably mounted on a horizontal crossbar or optionally on the plank frame 12, or on the plank 11. The first leg upper joint can be connected to the second leg upper section or the second leg lower section. The substantially vertical support member, first pair of legs, the second pair of legs, and the third pair of legs can each optionally have a reinforcing crossmember connecting the pair of left and right distal extremities to make a rigid connection.

The essential motion of the pair of first leg upper joints 14 is that they rotate about the upper end of the pair of first legs whether or not the axis of rotation is with the leg crossbar or adjacent to or below the first leg crossbar. The pair of first leg upper joints 14 can include the first leg crossbar. The pair of first leg upper joints 14 rotate at the substantially vertical support member swivel joint 36 when rigidly connected with the first leg crossbar. The pair of first leg upper joints 14 can be welded with a first leg crossbar so that the pair of first leg upper joints 14 are rigidly connected to swivel about the substantially vertical support member swivel joint 36. Also, the pair of first leg upper joints 14 can be welded with two first leg crossbars so that the pair of first leg upper joints 14 are swivel connected to swivel about the substantially vertical support member swivel joint 36. In this construction of the pair of first leg upper joints 14, the crossbar rotates at the substantially vertical support member swivel joint 36 so that the pair of first leg upper joints 14 provides rotation to the first legs about the substantially vertical support member swivel joint 36. The pair of first leg upper joints 14 can also be hinged or pivotally attached at the upper end of the pair of first legs, so that the pair of first leg upper joints 14 hinges or folds at a location underneath the first leg crossbar. The pair of first leg upper joints in this case excludes the first leg crossbar which can be rigidly connected or welded to the essentially vertical support member. Again, the essential motion of the pair of first leg upper joints 14 is that they rotate about the upper end of the pair of first legs whether or not the axis of rotation is with the leg crossbar or adjacent to or below the first leg crossbar.

The first leg 15 has a first leg sliding joint 18. The sliding joint can be a telescopic or sliding member that retracts to the stowed position and extends to the deployed position. The sliding joint can have an outside telescopic member that is rectangular or any other shape having a solid top or not solid top and a pair of sides that extend downwardly from the solid top. A solid top can be a plank of solid wood, or a not solid top can be a mesh screen, for example. The pair of sides of the sliding joint optionally each can have a slot for receiving a pin that slides within the slot. The pin can be fixed to the first leg 15 and protrude from the left side and right side of the first leg 15. The sliding joint outside telescopic member can also have the first leg upper joint 32 at an upper end of the first leg.

The second pair of legs has a second leg upper section 16 and a second leg lower section 17. The second pair of legs can be placed outside of the first pair of legs, or alternatively the second pair of legs can be placed inside the first pair of legs. The second pair of legs is laterally disposed from the first pair of legs. The first pair of legs and the second pair of legs both fold to a vertical position and deploy to a diagonal position. In deployed position, the second pair of legs can lean toward the user, while the first pair of legs can lean away from the user.

The second leg lower section 17 is jointed to the first leg 15 at a first leg middle joint 33. The second leg lower section can be formed as a rectangular metal member or suitable configuration.

The second leg has a joint above the first leg middle joint 33 at a second leg breaking joint 34. The second leg breaking joint 34 rotates from a straight position to a folded position when the table folds. The second leg breaking joint 34 can be above the first leg middle joint 33.

The second leg upper section 16 can be, but not necessarily be, made in a U-shaped channel and the second leg lower section 17 can be made in a U-shaped channel, or in any other kind of channel configuration. If the second leg upper section 16 U-shaped channel has an open side facing upward in the deployed position and the second leg lower section 17 U-shaped channel has an open side facing downward in the deployed position, the second leg upper section 16 U-shaped channel can fold into the open side of the second leg lower section 17 U-shaped channel when the second leg lower section 17 is folded to a folded and stowed position. Folding together can also be called a nesting configuration, where the second leg upper section nests inside the second leg lower section.

At a lower portion of the table, a lower platform 19 is supported by a lower platform support 20. The lower platform 19 folds upward and can have a lower platform folding joint coaxial to the second leg lower joint 35. The lower platform support 20 is pivotally connected to the lower platform 19 at a lower platform support inside joint 41. The lower platform support 20 can be pivotally connected to the first leg at a lower platform support outside joint 42. The lower platform support 20 can fit inside a slot located on an underside of the lower platform 19. The lower platform support 20 can also be aligned outside the lower platform 19 not in a slot.

During folding, the first leg sliding joint 18 can unlatch and shorten its length while folding down from a deployed position to a vertical folded position. The first leg 15 folds at the first leg upper joint 32. The second leg lower section 17 rotates relative to the first leg 15 at a first leg middle joint 33. The second leg lower section 17 can be coupled to the first leg 15 using a hinge pin inserted across the first leg middle joint 33.

During folding, the second leg breaks at the second leg breaking joint 34. The second leg upper section 16 swivels relative to the plank 11 at the second leg upper joint 31. The second leg upper section 16 rotates relative to the second leg lower section 17 at the second leg breaking joint 34. The second leg lower section 17 rotates relative to the substantially vertical support member 13 at the second leg lower joint 35. The second leg lower joint 35 can incorporate the crossbar member when the second leg is rigidly connected to the crossbar member.

The third leg 21 is optional. The third leg 21 has a third leg first joint member 22 and a third leg second joint member 23. The third leg is mounted to the substantially vertical support member 13 and swivels downward to provide support against tipping when the table is being folded. The third leg first joint member 22 is pivotally connected to the substantially vertical support member 13 at the substantially vertical support member swivel joint 36 and is connected to the third leg second joint member 23 at the third leg middle joint member joint 38. The third leg second joint member 23 is pivotally connected to the third leg 21 at the third leg second joint member joint 39. The third leg can lock into a deployed position for supporting the table.

Figure 10:
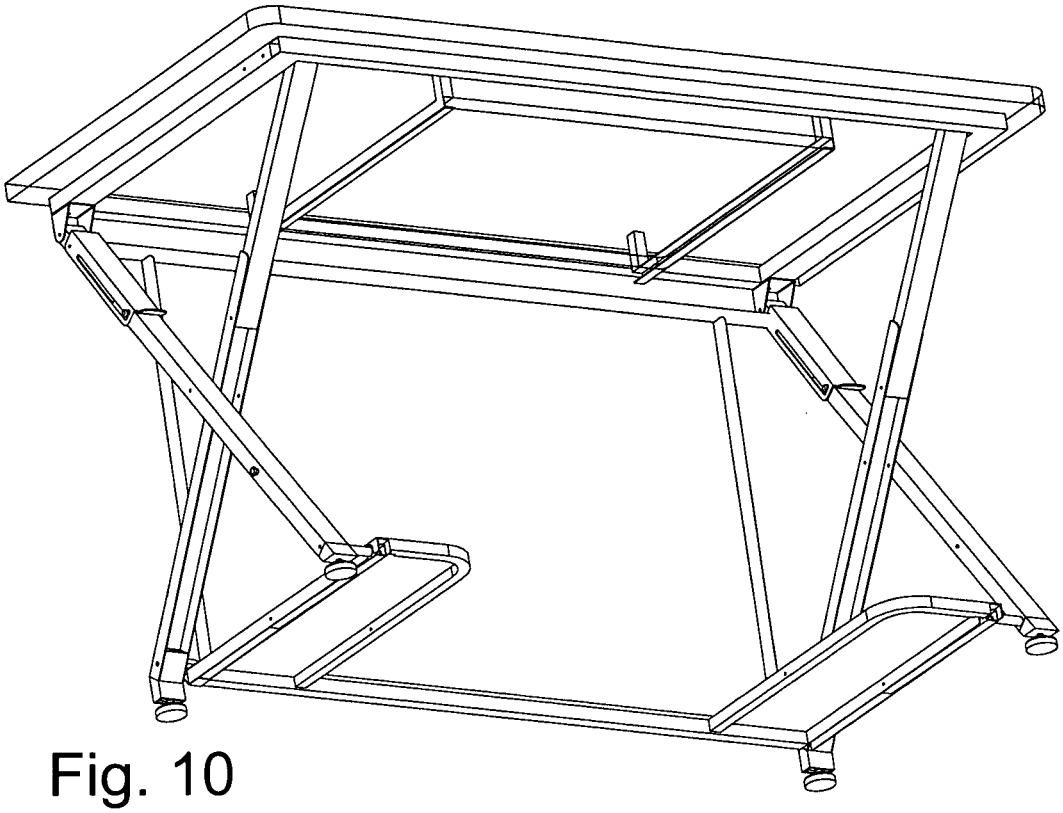
FIG. 10 is a perspective view of the present invention with the plank frame or plank directly connected to the first leg instead of to the substantially vertical support member.
Figure 11:
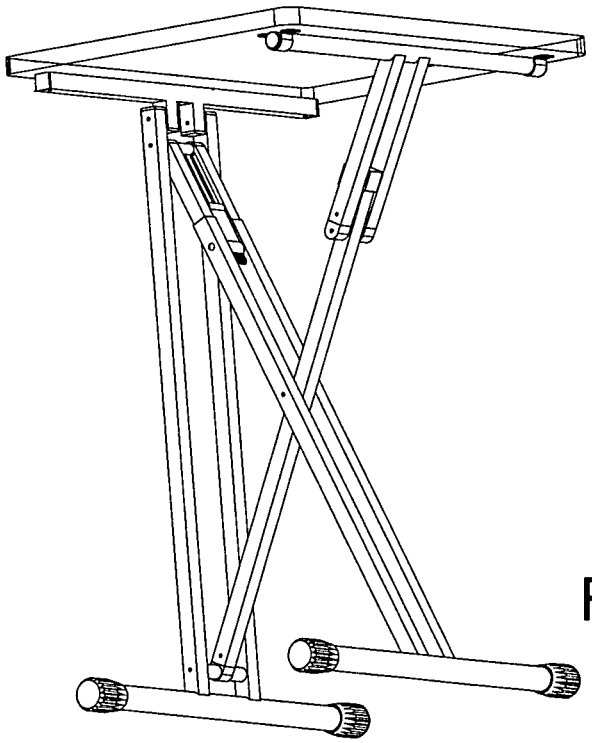
FIG. 11 is a perspective view of the present invention configured as a laptop table.
Figure 12:
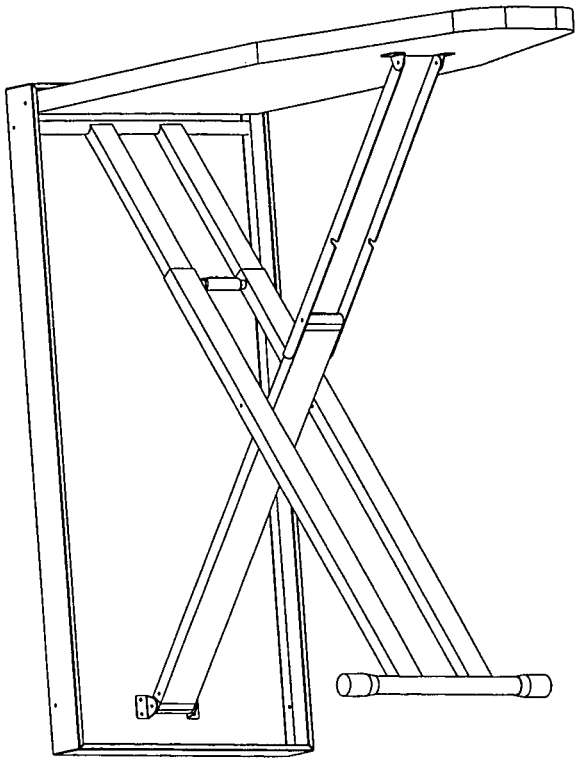
FIG. 12 is a perspective view of the present invention configured as an ironing board.
Figure 13:
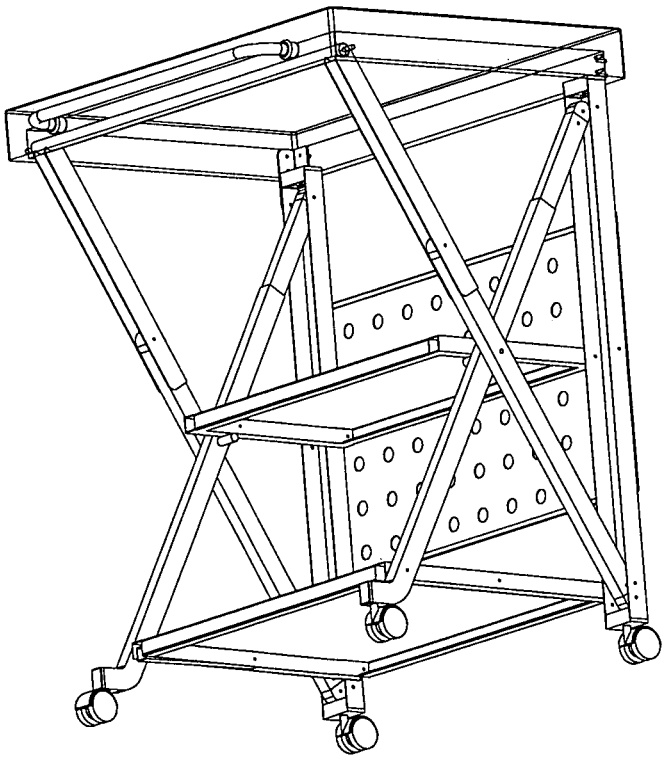
FIG. 13 is a perspective view of the present invention configured as a kitchen cart.

Per FIG. 10. the substantially vertical support member 13 can be pivotally connected to an upper portion of the first leg and pivotally connected to a lower portion of the second leg without being directly connected to the plank, plank frame or the floor. The substantially vertical support member 13 remains vertical even when connected only to the legs. The substantially vertical support member 13 can be a leg. The substantially vertical support member 13 can pivot relative to a bracket mounted to the plank.

The invention claimed is:

1. A folding table comprising:

a. a plank;

b. a substantially vertical support member, wherein the plank is rotationally directly or indirectly connected to the substantially vertical support member, wherein the plank rotates between a substantially horizontal plank deployed position and a substantially vertical plank stowed position;

c. a first leg, wherein the first leg has a first leg upper joint that allows the first leg to fold between a first leg deployed position and a first leg stowed position where the first leg is substantially vertical, wherein the first leg further includes a first leg sliding joint that retracts an upper portion of the first leg when the first leg is folding on the first leg upper joint between the first leg deployed position and the first leg position;

d. a second leg having a second leg first section and a second leg second section, wherein the second leg first section is jointed to the second leg second section, wherein the second leg first section is a second leg upper section, and wherein the second leg second section is a second leg lower section, wherein the second leg upper section is unfolded into a straight collinear position relative to the second leg lower section when the second leg is in a second leg deployed position, when the second leg upper section rotates relative to the second leg lower section, the second leg folds to a second leg stowed position; and e. a second leg upper joint, wherein the second leg upper joint supports the plank, wherein the plank deploys and stows with the second leg and the first leg.

2. The folding table of claim 1, further comprising: a third leg pivotally connected to the substantially vertical support member at a third leg swivel joint, wherein the first leg sliding joint telescopically retracts into the upper portion of the first leg when the first leg is folding on the first leg upper joint between the first leg deployed position and the first leg position.

3. The folding table of claim 1, wherein the second leg first section and the second leg second section nest with each other in the second leg stowed position.

4. The folding table of claim 1, further comprising: a lower platform supported by the first leg; and a lower platform support supporting the lower platform, wherein the lower platform support is pivotally connected to the first leg, wherein the lower platform support is pivotally connected to the lower platform.

5. The folding table of claim 1, wherein the plank further includes a plank frame.

6. The folding table of claim 1, wherein the substantially vertical support member is not directly bearing on the floor so that the substantially vertical support member does not touch the floor.

7. The folding table of claim 1, wherein the substantially vertical support member is not directly bearing on the plank so that the substantially vertical support member does not touch the plank.

8. The folding table of claim 1, wherein the second leg lower section is jointed to the first leg at a first leg middle joint.

9. The folding table of claim 1, wherein the first leg has a first leg upper end that connects to the second leg lower section.

10. The folding table of claim 9, wherein a first leg upper section lower joint is formed on the first leg and further includes a first leg sliding joint formed as a latch.

11. The folding table of claim 1, further comprising: a third leg pivotally connected to the substantially vertical support member at a third leg swivel joint, wherein the third leg is connected to the substantially vertical support member at a third leg swivel joint, and wherein the third leg is swivel connected to the first leg at a first leg lower joint, wherein the first leg is connected to the second leg upper section at an intermediate first leg upper joint.

12. The folding table of claim 1, further including a second plank, wherein the second plank is mounted to the substantially vertical support member at a second plank main swivel, wherein the second plank is supported by a second plank support, wherein the second plank is swivel connected to the second plank support at a second plank outside swivel.

13. The folding table of claim 1, wherein the first leg has a first leg first section and a first leg second section, wherein the first leg first section slides relative to the first leg second section to telescope in length when the table is folded between a deployed position and a stowed position.

14. The folding table of claim 13, further comprising: a third leg pivotally connected to the substantially vertical support member at a third leg swivel joint, wherein the third leg is connected to the substantially vertical support member at a third leg swivel joint, and wherein the third leg is swivel connected to the first leg at a first leg lower joint, wherein the second plank rail support is pivotally attached to the second plank side rails at a second plank outside swivel, wherein the first leg has a first leg first section and a first leg second section, wherein the first leg first section slides relative to the first leg second section to telescope in length when the table is folded between a deployed position and a stowed position, wherein the first leg has an adjustable length.

* * * * *